United States Patent [19]

Lucas

[11] 4,102,489

[45] Jul. 25, 1978

[54] BUSINESS REPLY FORM

[75] Inventor: Roland T. Lucas, Milwaukee, Wis.

[73] Assignee: St. Luke's Hospital Research Foundation, Inc., Milwaukee, Wis.

[21] Appl. No.: 856,214

[22] Filed: Dec. 1, 1977

[51] Int. Cl.[2] ..... B65D 27/06

[52] U.S. Cl. ..... 229/73; 229/92.3; 282/22 R

[58] Field of Search ..... 229/73, 92.1, 92.3; 282/22 R

[56] References Cited

U.S. PATENT DOCUMENTS

| | | | |
|---|---|---|---|
| 1,551,660 | 9/1925 | Gove | 229/92.3 |
| 1,639,566 | 8/1927 | Johnson | 229/92.1 |
| 2,341,788 | 2/1944 | Jones | 282/22 R |
| 2,400,356 | 5/1946 | Kerr et al. | 282/22 R |
| 2,985,464 | 5/1961 | McFarland | 229/73 |
| 3,073,509 | 1/1963 | Schuessler | 229/92.3 |
| 3,250,456 | 5/1966 | Schuessler | 229/92.1 |
| 3,507,519 | 4/1970 | McNabb | 229/73 |
| 3,843,042 | 10/1974 | Mayne | 229/73 |

*Primary Examiner*—Stephen P. Garbe
*Attorney, Agent, or Firm*—James E. Nilles

[57] ABSTRACT

A business reply form to be mailed from a sender to a recipient initially comprises two detachably connected folded sealed sheets; namely, a first instruction sheet which is to be retained by the recipient; and a second questionnaire sheet which is to be detached from the first instruction sheet, filled out by the recipient, folded, and returned by mail to the sender. The second questionnaire sheet includes the name and address of the recipient typed thereon in an address space and the first sheet contains a window in registry with the address space through which the name and address of the recipient appears when the form is initially mailed to the recipient. Thus, one entry of the recipient's name and address on the second sheet by the sender enables the form to be mailed to the recipient and also serves to identify the recipient when the second questionnaire sheet is returned to sender.

14 Claims, 12 Drawing Figures

BUSINESS REPLY FORM

BACKGROUND OF THE INVENTION

1. Field of Use

This invention relates generally to business reply forms for use between a sender and a recipient, and in particular, to a two-sheet form initially mailable by sender and comprising and information sheet to be retained by the recipient and a questionnaire to be returned to the sender.

2. Description of the Prior Art

The prior art contains several examples of mailable business reply forms and the following U.S. patents illustrate the state of the art:

| | | |
|---|---|---|
| 4,044,942 | 3,995,808 | 3,977,597 |
| 3,955,750 | 3,899,127 | 3,843,042 |
| 3,790,070 | 3,303,987 | 2,723,078 |

Business reply forms are usually designed and constructed to facilitate specific types of business transactions and to take into account any peculiarities of the specific transaction so as to anticipate and avoid problems which are repeatedly encountered. As a practical example, a hospital needs to provide a prospective surgical patient with a specific date and time for admittance to the hospital and with general information regarding in-patient admittance. In addition, it is necessary for the patient to complete a pre-admission questionnaire. Heretofore, some hospitals mailed the specific and general information and the questionnaire to the patient in a conventional envelope. Then, the patient mailed the completed questionnaire to the hospital in a self-addressed postage prepaid return envelope provided by the hospital. However, it sometimes happens that the patient fails to include his name on the questionnaire or envelope being returned to the hospital and the hospital is unable to identify the patient to whom the questionnaire data pertains. Thus, additional correspondence and phone calls and needless follow-up administrative procedures and expense are required.

SUMMARY OF THE PRESENT INVENTION

A business reply form in accordance with the invention is especially suitable for use by hospitals and clinics as an inpatient admitting form but is also usable in other business transactions.

In accordance with the invention, a business reply form, such as an inpatient admitting form, to be mailed from a sender, such as a hospital, to a recipient, such as a prospective patient, initially comprises two detachably connected folded sealed sheets; namely, a first instruction sheet which is to be retained by the patient recipient; and a second questionnaire sheet which is to be detached from the first instruction sheet, filled out by the patient, re-folded, and returned by mail to the hospital sender. The second questionnaire sheet includes the name and address of the recipient typed thereon in an address space by the hospital sender and the first sheet contains a window in registry with the address space through which the name and address of the patient recipient appears when the form is initially mailed to the recipient. Thus, one entry of the patient recipient's name and address on the second sheet by the hospital sender enables the form to be mailed to the recipient and also serves to identify the patient recipient when the second questionnaire sheet is returned to hospital sender.

More specifically, the business reply form comprises a first information sheet foldable in one direction and a second questionnaire sheet foldable in said one direction and being shorter than said first information sheet. Each sheet has outer and inner sides, top and bottom edges, and upper and lower sections separated by a fold line, and both sheets are secured together along their top edges. First perforated tear lines are spaced from the top and bottom edges of each sheet and define first tear strips. A second perforated tear line is spaced from the first tear line at the top edge of the second sheet and defines a second tear strip. A first layer of contact adhesive covered by a removable peel-away strip is provided on the outer side of the first tear strip at the top edge of the second sheet for engagement with the inner side of the first tear strip at the bottom edge of the first sheet when both sheets are folded in the said one direction. A second layer of contact adhesive covered by a removable peel-away strip is provided on the inner side of the first tear strip at the bottom edge of the second sheet for engagement with the inner side of the second tear strip at the top edge of the second sheet when said second sheet is folded in a direction opposite to the said one direction. An address space is provided on the inner side of the second sheet and a window is provided in the first sheet in registration with the address space.

The first sheet contains information for the patient recipient and the second sheet contains a questionnaire to be completed and returned by the recipient to the sender. The lower section of the first sheet contains the window and also contains the preprinted address of said sender on the outer side thereof. The lower section of the second sheet contains the preprinted address of the sender on the outer side thereof. Preprinted postage is provided on the outer side of the lower section of the first and second sheets. The inner side of the lower section of the first sheet includes a space for entry by the sender of specific information for the recipient. The first and second sheets are initially formed from first and second webs of paper, respectively, each web having spaced apart lateral edges which define the top and bottom edges of the sheets cut therefrom.

A form in accordance with the invention has numerous advantages over prior art business reply forms. For example, the form enables a single entry of the recipient's name and address to serve as the mailing address when the form is mailed from the sender to the recipient and also serves to identify the questionnnaire when it is returned by recipient to sender. Thus, there is no possibility of the sender returning a questionnaire which fails to identify the sender. Furthermore, since in a preferred embodiment the name and address of the sender is preprinted as the return address on one sheet of the form when initially mailed and appears on the other sheet of the form when the latter is returned in the mail by the sender, there is no need for either recipient or sender to fill in sender's address. Similarly, inclusion of preprinted prepaid postage on the forms eliminates another processing step for sender and recipient. A form in accordance with the invention is economically manufactured, easily and compactly stored pending its use, is easily used by sender and recipient and is virtually fool-proof in use. Other objects and advantages of the invention will hereinafter appear.

DESCRIPTION OF A PREFERRED EMBODIMENT

Figure 1:
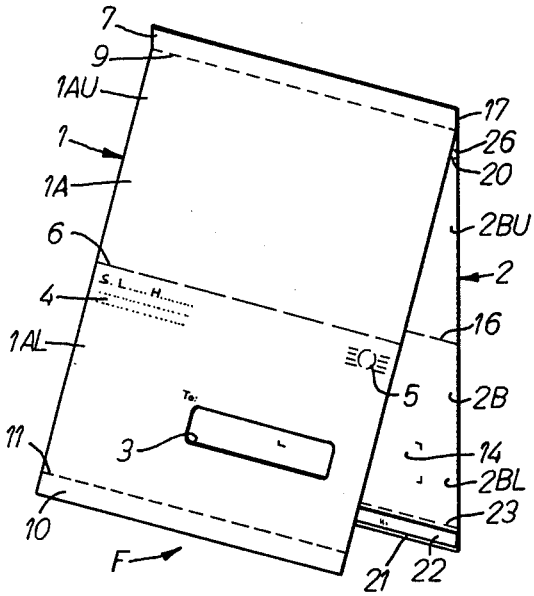
FIG. 1 is a perspective view of one side of an unfolded two-sheet form in accordance with the invention.
Figure 2:
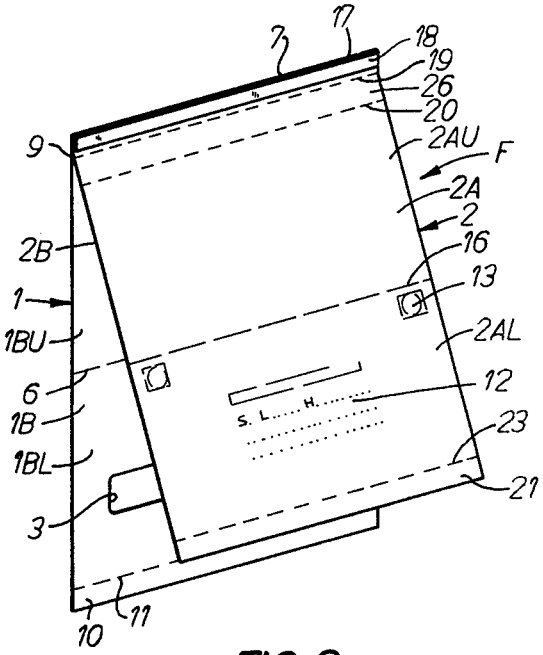
FIG. 2 is a view similar to FIG. 1 of the other side of the form.
Figure 3:
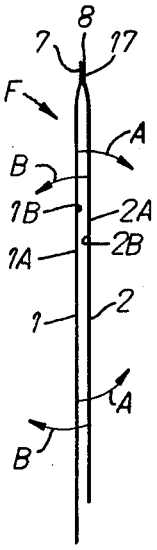
FIG. 3 is a side view of the unfolded two-sheet form of FIGS. 1 and 2.
Figure 4:
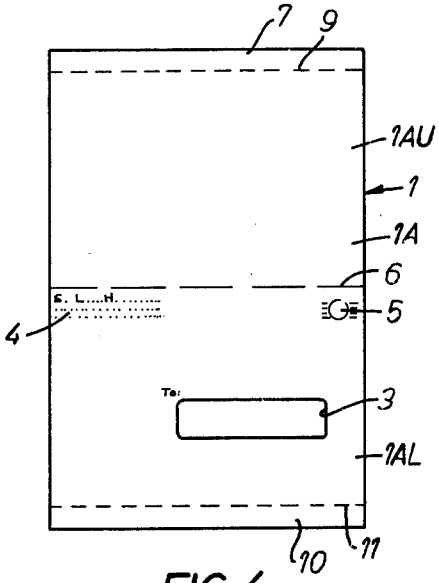
FIG. 4 is a plan view of the outer side of the first sheet of the form.
Figure 5:
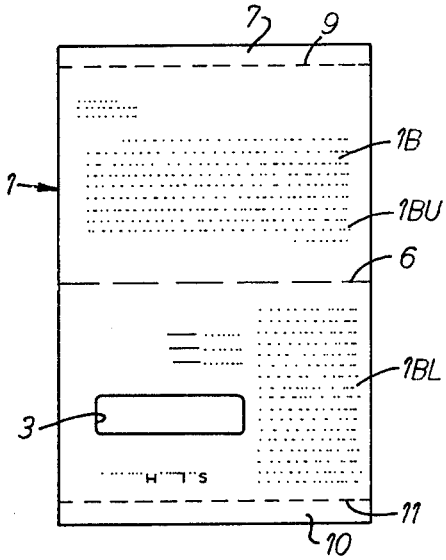
FIG. 5 is a plan view of the inner side of the first sheet of the form.
Figure 6:
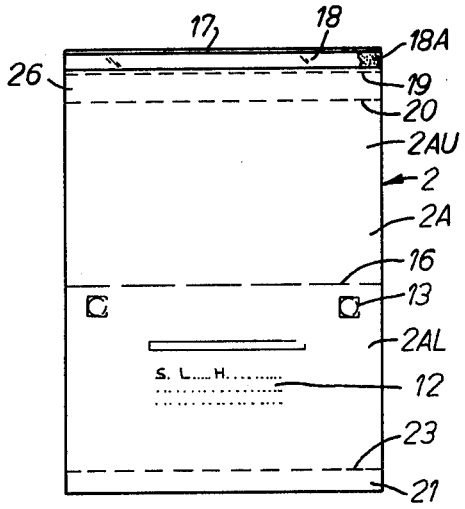
FIG. 6 is a plan view of the outer side of the second sheet of the form.
Figure 7:
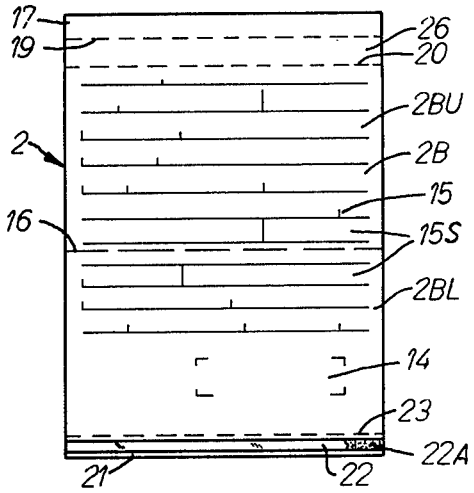
FIG. 7 is a plan view of the inner side of the second sheet of the form.

Referring to FIGS. 1, 2, and 3, form F, shown in unfolded condition, comprises a first information or instruction sheet 1 which is to be kept by the recipient to whom form F is mailed by the sender and a second questionnaire sheet 2, slightly shorter than sheet 1 (see FIG. 3), which is to be filled out by the recipient and returned by mail to the sender. In the embodiment disclosed herein form F will be described as an inpatient admitting form for use between a hospital sender and a patient recipient.

Figure 8:
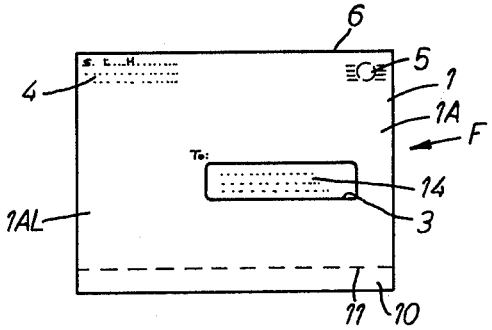
FIG. 8 is a plan view of the folded two-sheet form ready for mailing by the sender to the recipient and depicts the lower section of the outer side of the first sheet.
Figure 9:
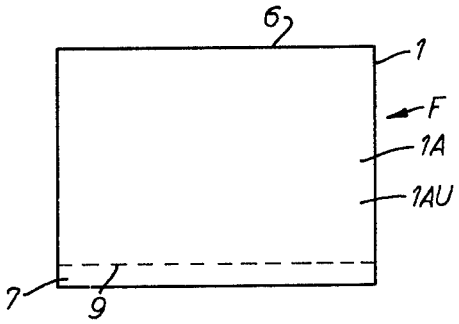
FIG. 9 is a plan view of the rear of the form shown in FIG. 8 and depicts the upper section of the outer side of the first sheet.
Figure 10:
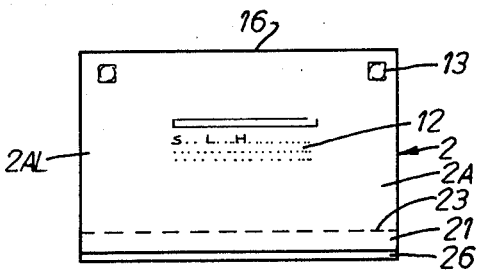
FIG. 10 is a plan view of the folded second questionnaire sheet ready for mailing by the recipient to the sender and depicts the lower section of the outer side of the second sheet.
Figure 11:
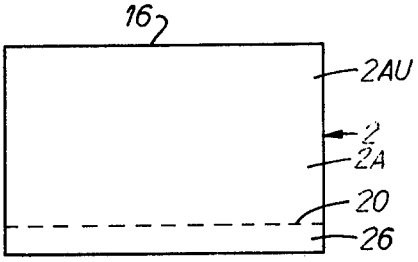
FIG. 11 is a plan view of the folded second questionnaire sheet shown in FIG. 10 and depicts the upper section of the outer side of the second sheet.

FIGS. 8 and 9 show form F in folded sealed condition in which it is mailed to and received by the recipient. FIGS. 10 and 11 show the second questionnaire sheet 2 after it has been detached from form F (i.e., from first sheet 1) and in folded sealed condition in which it is mailed to and received by the sender.

As FIGS. 1, 2, 3, 4, 5, 8, and 9 show, the first sheet 1 comprises an outer side 1A having a blank upper section 1AU and a lower section 1AL in which a cut-out or window 3 is provided and on which the sender's (hospital's) return address 4 and prepaid postage 5 to recipient are imprinted.

The first sheet 1 also comprises an inner side 1B having an upper section 1BU and a lower section 1BL on which information is imprinted, such information including, for example, a specified date and time (see FIG. 5) for the admission of the recipient patient to the hospital and general preadmission instructions.

First sheet 1 includes a fold line 6 and an upper tear strip 7 defined by a perforated upper tear line 9 and having glue 8 (see FIG. 3) on its inner side whereby sheet 1 is secured to sheet 2. First sheet 1 also includes a lower tear strip 10 defined by a perforated lower tear line 11.

As FIGS. 1, 2, 3, 6, 7, 10 and 11 show, the second sheet 2 comprises an outer side 2A having a blank upper section 2AU and a lower section 2AL on which the sender's (hospital's) address 12 and postage 13 to sender (hospital) are imprinted.

The second sheet 2 also comprises an inner side 2B having an upper section 2BU and a lower section 2BL on which a questionnaire 15 is imprinted which has spaces 15S which the recipient is to fill out to answer the questions. Lower section 2BL also includes a space 14 which registers with the window 3 of sheet 1 and in which the recipient's (patient's) name and address are entered, as by typing, by the sender (hospital). Thus, the recipient's name and address, although entered only once by the sender, serves to mail form F to the recipient (patient) and also identifies the question sheet 2 when it is returned to the sender (hospital).

Second sheet 2 includes a fold line 16 and an upper tear strip 17 defined by a perforated first upper tear line 19. Tear strip 17 has glue 8 (see FIG. 3) on its inner side whereby sheet 2 is secured to sheet 1. Tear strip 17 also has a peel-away protective strip 18 overlying a layer of contact adhesive 18A (see FIG. 6) on its outer side.

Second sheet 2 also includes a second upper tear strip 26 defined by a perforated second upper tear line 20.

Second sheet 2 further includes a lower tear strip 21 defined by a perforated lower tear line 23 which has a peel-away protective strip 22 overlying a layer of contact adhesive 22A (see FIG. 7) on its inner side.

The form F is employed as follows. Assuming that form F is in the unfolded condition shown in FIGS. 1, 2, and 3, the sender (hospital) carries out the following steps:

1. The recipient's (patient's) name and address are entered on lower section 2BL of the inner side of sheet 2 as by typing.

2. The specific information (time and date of hospital admission, for example) are entered on lower section 1BL of the inner side of sheet 1 as by typing.

3. The protective peel-away strip 18 is removed from tear strip 17 at the top of the outer side 2A of sheet 2 to expose the contact adhesive 18A therebeneath.

4. The form F is folded along fold lines 6 and 16 in one direction (see arrows A in FIG. 3).

5. The inner side of tear strip 10 is sealed to the contact adhesive 18A on tear strip 17.

6. The form F in the folded and sealed condition shown in FIGS. 8 and 9 is deposited in the mail to the recipient (patient).

Now, assuming that form F in the condition shown in FIGS. 8 and 9 is received by the recipient (patient), the latter carries out the following steps:

1. The glued-together tear strips 7 and 17 and the sealed-together tear strips 17 and 10 are simultaneously detached by being torn off along the tear lines 9, 19, and 11, respectively, to cause the sheets 1 and 2 to be separated and enable them to be unfolded.

2. The information sheet 1 is retained for reference by the recipient (patient).

3. Questionnaire sheet 2 is filled out by the recipient (patient).

4. The protective peel-away strip 22 is removed from tear strip 21 at the bottom of sheet 2 to expose the contact adhesive 22A therebeneath.

5. Sheet 2 is folded on fold line 16 in the opposite direction to its previous folding (see arrows B in FIG. 3).

6. The inner side of second upper tear strip 26 is sealed to the contact adhesive 22A on tear strip 21.

7. The sheet 2 in the folded and sealed condition shown in FIGS. 10 and 11 is deposited in the mail to the sender (hospital.)

Finally, assuming that questionnaire sheet 2 in the condition shown in FIGS. 10 and 11 is received by the sender (hospital), the latter carries out the following steps:

1. The sealed-together tear strips 21 and 26 are simultaneously detached from sheet 2 by being torn off along the tear lines 23 and 20, respectively, to enable sheet 2 to be unfolded.

2. The questionnaire sheet 2 is retained for reference by the sender (hospital).

In the embodiment of the invention disclosed herein, the first and second sheets 1 and 2, respectively, are shown as joined together at their top edges by glue 8. However, it is to be understood that these sheets could be integrally joined along their top edges and folded thereat so as to provide in effect two separate sheets.

Figure 12:
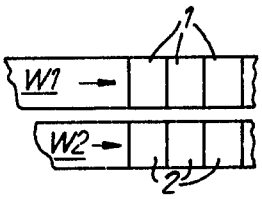
FIG. 12 is a plan view of two webs of paper from which the sheets comprising the forms are initially cut.

As FIG. 12 shows, the sheets 1 and 2 are initially cut from continuous webs W1 and W2, respectively. As is clear, the spaced apart lateral side edges of the webs define the top and bottom edges of the sheets. This orientation of the sheets relative to the webs from which they are manufactured facilitates continuous application of the contact adhesive and facilitates continuous formation of the various tear lines and fold lines. A form in accordance with the present invention is thus economically and expeditiously fabricated and all pertinent information except the name and address of the recipient, the specific time and date for hospital admission, for example, and the answers to the questionnaire can be provided on the form prior to its use. Although the form disclosed therein is especially well-suited as a preadmission form in hospitals, by changing the nature of the questionnaire, it could be adapted for any comparable business purpose.

I claim:

1. A business reply form for use between a sender and a recipient comprising:

a first sheet foldable in one direction;

a second sheet foldable in said one direction and shorter than said first sheet;

each sheet having outer and inner sides and top and bottom edges and said sheets being secured together along their top edges;

first tear lines spaced from the top and bottom edges of each sheet and defining first tear strips;

a second tear line spaced from said first tear line at the top edge of said second sheet defining a second tear strip;

a first layer of adhesive for securing the outer side of the first tear strip at the top edge of said second sheet with the inner side of the first tear strip at the bottom edge of said first sheet when both sheets are folded in said one direction;

a second layer of adhesive for securing the inner side of the first tear strip at the bottom edge of said second sheet with the inner side of the second tear strip at the top edge of said second sheet when said second sheet is folded in a direction opposite to said one direction;

an address space on the inner side of said second sheet;

and a window in said first sheet in registration with said address space.

2. A business reply form according to claim 1 wherein said first layer of adhesive is on the outer side of said first tear strip at the top edge of said second sheet.

3. A business reply form according to claim 2 wherein said second layer of adhesive is on the inner side of said first tear strip at the bottom edge of said second sheet.

4. A business reply form according to claim 3 wherein said layers of adhesive are contact adhesive and wherein each layer is covered by a removable peel-away protective strip.

5. A business reply form according to claim 1 wherein said second layer of adhesive is on the inner side of said first tear strip at the bottom edge of said second sheet.

6. A business reply form according to claim 1 wherein said first sheet contains information for said recipient and wherein said second sheet contains a questionnaire to be completed and returned by said recipient to said sender.

7. A business reply form according to claim 6 wherein said outer side of said first and second sheets each contain the address of said sender.

8. A business reply form according to claim 1 wherein said first and second sheets are initially formed from first and second webs of paper, respectively, each web having spaced apart lateral edges which define said top and bottom edges of said sheets.

9. A business reply form for use between a sender and a recipient comprising:

a first information sheet foldable in one direction;

a second questionnaire sheet foldable in said one direction and being shorter than said first information sheet;

each sheet having outer and inner sides, top and bottom edges, and upper and lower sections separated by a fold line, and said sheets being secured together along their top edges;

first tear lines spaced from the top and bottom edges of each sheet and defining first tear strips;

a second tear line spaced from said first tear line at the top edge of said second sheet thereof and defining a second tear strip;

a first layer of contact adhesive covered by a removable peel-away strip on the outer side of the first tear strip at the top edge of said second sheet for engagement wiht the inner side of the first tear strip at the bottom edge of said first sheet when both sheets are folded in said one direction;

a second layer of contact adhesive covered by a removable peel-away strip on the inner side of the first tear strip at the bottom edge of said second sheet for engagement with the inner side of the second tear strip at the top edge of said second sheet when said second sheet is folded in a direction opposite to said one direction;

an address space on the inner side of said second sheet;

and a window in said first sheet in registration with said address space.

10. A business reply form according to claim 9 wherein said first sheet contains information for said recipient and wherein said second sheet contains a questionnaire to be completed and returned by said recipient to said sender.

11. A business reply form according to claim 10 wherein said outer side of said first and second sheets each contain the address of said sender.

12. A business reply form according to claim 11 wherein the lower section of said first sheet contains said window and contains the preprinted address of said sender on the outer side thereof, and wherein the lower section of said second sheet contains the preprinted address of said sender on the outer side thereof.

13. A business reply form according to claim 12 wherein preprinted postage is provided on the outer side of the lower section of said first and second sheets.

14. A business reply form according to claim 12 wherein said inner side of said lower section of said first sheet includes a space for entry by sender of specific information for recipient.

* * * * *